US006618900B2

(12) United States Patent
Spork et al.

(10) Patent No.: US 6,618,900 B2
(45) Date of Patent: Sep. 16, 2003

(54) LOCKABLE CARRIER HINGE ASSEMBLY

(75) Inventors: Nigel Frank Spork, Hendra (AU); Glen Douglas Pacholke, Eatons Hill (AU)

(73) Assignee: Centor Products Pty. Ltd. (AU)

( * ) Notice: Subject to any disclaimer, the term of this patent is extended or adjusted under 35 U.S.C. 154(b) by 0 days.

(21) Appl. No.: 10/137,821

(22) Filed: May 1, 2002

(65) Prior Publication Data

US 2002/0162190 A1 Nov. 7, 2002

(30) Foreign Application Priority Data

May 4, 2001 (AU) ..... PR 4807

(51) Int. Cl.[7] ..... A47H 15/00; E05D 15/06

(52) U.S. Cl. ..... 16/87 R; 16/87.6 R; 16/94 D; 16/96 D; 16/102; 16/105

(58) Field of Search ..... 16/87 R, 87.2, 16/87.6 R, 94 D, 96 D, 102, 105, 241, 242, 243, 244; 160/115, 118, 123, 201, 229.1

(56) References Cited

U.S. PATENT DOCUMENTS 1,336,780 A * 4/1920 Hickey ..... 16/244
2,779,966 A * 2/1957 Torchia ..... 16/244
3,600,743 A * 8/1971 Meadows ..... 16/278
3,874,029 A * 4/1975 McCullough ..... 16/329
4,073,037 A * 2/1978 Curry et al. ..... 16/304
4,564,974 A * 1/1986 McGrail et al. ..... 16/353
4,999,937 A * 3/1991 Bechtold ..... 40/610
5,139,071 A * 8/1992 Danchulis ..... 160/115
5,411,072 A * 5/1995 Starck et al. ..... 160/84.11
5,472,037 A * 12/1995 Hoffman ..... 160/183
5,568,673 A * 10/1996 Ryczek ..... 16/244
5,913,352 A * 6/1999 Scates et al. ..... 160/229.1

FOREIGN PATENT DOCUMENTS

AU 9947374 A * 3/2000
AU 726943 11/2000

* cited by examiner

*Primary Examiner*—Chuck Y. Mah
(74) *Attorney, Agent, or Firm*—Cantor Colburn LLP

(57) ABSTRACT

A carrier hinge assembly is used to suspend adjacent hinged panels from a track. The assembly has a carriage which travels along the track, and a hinge dependent from the carriage. The hinge is formed by a hinge pin having an upper portion threaded into a boss on the carriage, and hinge leaves which are pivotable about the hinge pin. The hinge leaves are fixed, in use, to opposing edge faces of the panels. The height of the panels may be adjusted by rotation of the hinge pin. A locking mechanism includes a retractable lock tongue located in an axial slot in a stop at the bottom of the hinge pin. The lock tongue is biased by spring to engage an axial slot in hinge leaf, to key the hinge pin to the hinge leaf and prevent relative rotation.

19 Claims, 7 Drawing Sheets

LOCKABLE CARRIER HINGE ASSEMBLY

FIELD OF THE INVENTION

This invention relates to a carrier hinge assembly suitable for suspending adjacent panels, such as those of folding doors, from a track. In particular, the invention is directed to a carrier hinge assembly having a positive locking mechanism for preventing excessive rotation of the hinge pin.

BACKGROUND ART

A carrier hinge assembly is used to suspend a pair of hinged panels (such as the panels of a folding door) from an overhead horizontal track while permitting the panels to pivot relative to each other about a vertical hinge axis. An example of a carrier hinge is illustrated in Australian patent no. 726943 and the disclosure of that patent is incorporated herein by reference.

The known carrier hinge assembly has a wheeled carriage which rides along the track. A vertical hinge pin is attached to the carriage and depends therefrom. A hinge is formed on the vertical hinge pin, and comprises a pair of leaves, each hinge leaf being attached, in use, to the edge face of a respective panel.

Throughout the specification, including the claims, where the context permits, the term "panel" is intended to include the generally planar closure components of folding doors, windows, shutters, screens and similar closures. The invention will be described with particular reference to its application to panels of a folding door system, but without limitation thereto.

A carrier is sometimes referred to in the trade as a "hanger" and the use of the term "carrier" or "carriage" in the specification is intended to include a hanger or like device.

An advantageous feature of the carrier hinge assembly of Australian patent no. 726943 is that it permits height adjustment of the suspended panels. Such adjustment may be required from time to time to prevent the door panels from sticking, or otherwise to facilitate smooth movement of the door panels. For this purpose, the upper portion of the hinge pin is threaded into the carriage, so that the vertical position of the suspended door panels relative to the carriage or track can be adjusted by rotating the hinge pin. The lower end of the hinge pin is typically formed as an enlarged head with a screwdriver slot, to allow the hinge pin to be turned with a screwdriver.

It is important to ensure that once the hinge assembly has been properly adjusted, it does not lose its adjustment i.e. that there is no undue rotation of the hinge pin. Australian patent no. 726943 teaches the use of a locking nut to lock the hinge pin against undesired rotation. The locking nut is screwed against the carriage so that the hinge pin is effectively clamped to the carriage and held frictionally against relative rotation.

A disadvantage of the known locking nut arrangement is that the locking nut is often difficult to access, as it is typically positioned very close to the track in use. (The nut may be concealed by a pelmet). Further, locked nuts inevitably become loose over time, allowing the hinge pin to turn and eventually causing the door panels to become misaligned. It is widely recognised in the industry that adjustment mechanisms for folding doors are very difficult to secure, and users are resigned to folding doors coming out of adjustment over time.

It is an object of this invention to overcome the above described disadvantage by providing a carrier hinge assembly having a locking mechanism which guards against loss of adjustment by preventing excessive rotation of the hinge pin.

It is another object of the invention to provide a carrier hinge assembly having a locking means which is more readily accessible and easier to operate than conventional locking nuts.

SUMMARY OF THE INVENTION

In one broad form, the invention provides a carrier hinge assembly for suspending adjacent panels from a track, the assembly including:

a carriage adapted to travel along the track;

a hinge comprising a hinge pin depending from the carriage, the hinge pin being rotatable about its longitudinal axis relative to the carriage, and at least one hinge leaf pivotable about the hinge pin, the hinge leaf being adapted to be fixed to an edge face of a respective panel, in use; and a locking mechanism for keying the hinge pin to the hinge leaf to prevent relative rotation there between.

The hinge pin is typically threaded into the carriage. In this manner, the distance between the hinge leaf and the carriage (and hence the height of the panels) can be varied by rotating the hinge pin about its axis. The carriage may be provided with a depending boss having a threaded bore therein which receives a threaded upper end of the hinge pin.

In one embodiment, the locking mechanism comprises a lock member, in the form of a lock tongue or key, which is adapted to locate simultaneously in the hinge pin and the hinge leaf so that it prevents relative rotation between the hinge pin and the hinge leaf. In this embodiment, the hinge pin has a first axial slot in its lower end, and the hinge leaf has a second axial slot in its lower end. The first and second slots can be axially aligned by relative rotation of the hinge leaf and the hinge pin. When the slots are axially aligned, the lock member can locate in both slots, to thereby key the hinge pin to the hinge leaf.

Typically, the hinge pin has an enlarged head at its lower end which forms an axial stop for the hinge leaf. The first slot is provided in the enlarged head. The second slot is typically provided in a knuckle portion of the hinge leaf.

The lock member is preferably biased into engagement with the second slot by a biasing device, such as a spring. The lock member is retractable against the bias of the spring to enable it to withdraw from the second slot, and thereby permit relative rotation between the hinge pin and the hinge leaf.

The lock member may suitably be a planar key member which locates in the first slot, and can slide axially into engagement with the second slot. The key member may have an angled outer end overlying the lower end of the hinge pin, to enable it to be grasped and retracted against the bias of the spring. A removable spacer may be used to hold the key member in a retracted position against the spring bias.

The locking mechanism provides positive locking between the hinge pin and the hinge leaf, to ensure that once the height of the panels has been adjusted, the height adjustment is maintained (within a small variation due to pivotal movement of the hinge leaf as its associated panel is opened and closed). Furthermore, by locating the locking mechanism at the lower end of the hinge pin, it is readily accessible, even if the carriage is located in a track and the top end of the hinge pin is concealed behind a pelmet.

In another embodiment, the locking mechanism is a U-shaped clip which fits around the head of the hinge pin and engages axial slots in the hinge leaf knuckle.

In order that the invention may be more fully understood and put into practice, preferred embodiments thereof will now be described by way of example, with reference to the accompanying drawings.

DESCRIPTION OF PREFERRED EMBODIMENTS

Figure 1:
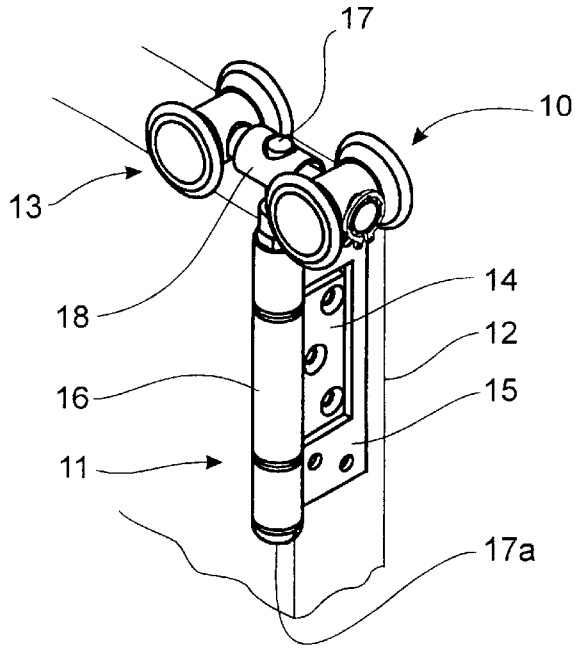
Fig. 1 (Prior Art)
FIG. 1 is a perspective view of a known carrier hinge assembly.
Figure 2:
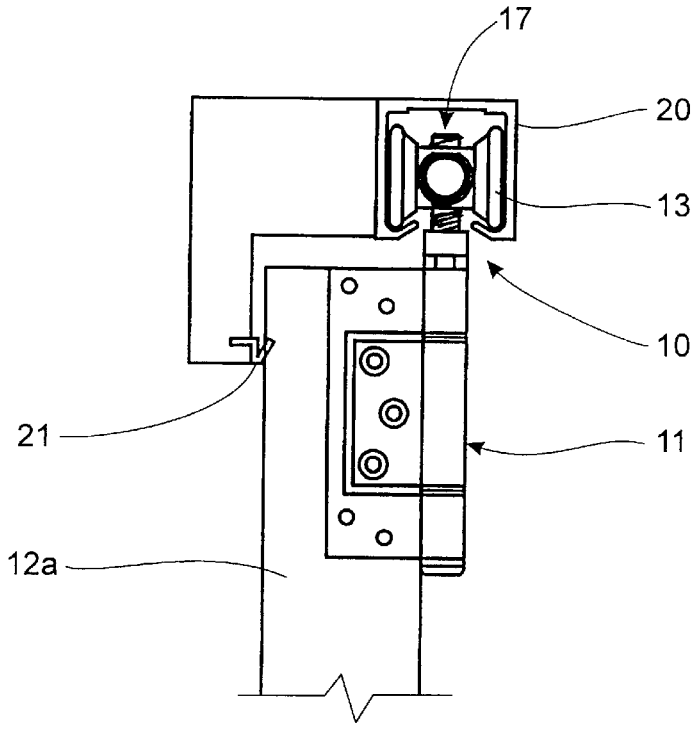
Fig. 2 (Prior Art)
FIG. 2 is an end elevation of the known carrier hinge assembly of FIG. 1.
Figure 3:
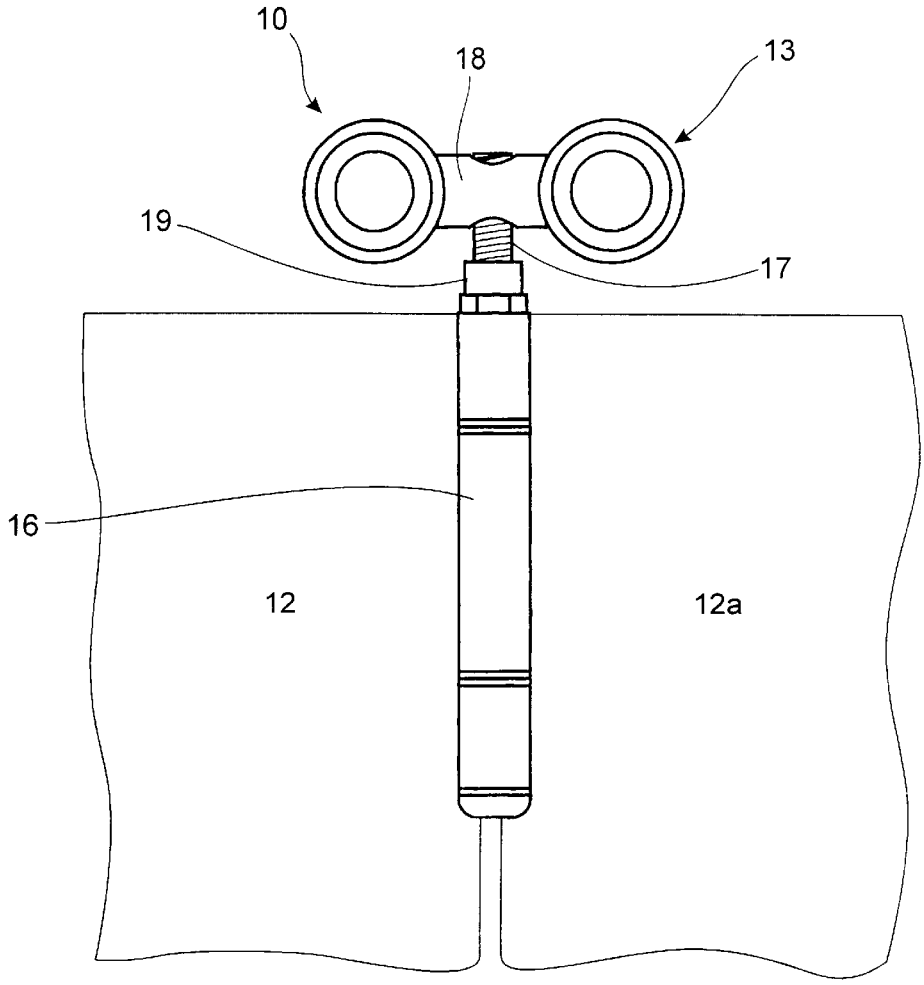
Fig. 3 (Prior Art)
FIG. 3 is a fragmentary rear elevation of a folding door utilising the known carrier hinge assembly of FIG. 1.

As shown in FIGS. 1–3, a known combination carrier hinge assembly 10 comprises a hinge 11 suspended from a carriage 13. The hinge 11 is connected, in use, to the edge faces of adjacent panels 12, 12*a* of a folding door. (For clarity, panel 12*a* has been omitted from FIG. 1, and panel 12 has been omitted from FIG. 2). The carriage 13 is adapted to travel along an overhead track 20. The carriage 13 is typically in the form of a bogie having two spaced pairs of wheels or rollers.

The hinge 11 is a flush or non-mortise hinge with two interfolding or interfitting leaves 14, 15 which are screwed or otherwise affixed to the edges of panels 12, 12*a*, respectively. The leaves 14, 15 are typically each half swaged, and are integrally formed with a respective portion of the knuckle 16 of butt hinge 11. The knuckle 16 defines a tubular cavity in which a hinge pin 17 is located.

The hinge pin 17 has a threaded upper end which protrudes above the hinge 11 and is threaded into a nut 18 or similar component of the carriage 13. The hinge pin 17 is suitably provided with a screw head 17*a* or socket head to enable the hinge pin to be screwed into the nut 18. Screwing the hinge pin 17 into, or out of, the nut 18 varies the distance between the hinge 11 and the carriage 13. As the hinge 11 is fixed to the panels, and the carriage 13 is mounted on the fixed track 20, it will be evident that the height of the panels can be adjusted by varying the extent to which the hinge pin 17 is threaded into nut 18.

A locking nut 19 is provided on the threaded upper end of the hinge pin 17. Once the hinge pin 17 has been screwed into the nut 18 to the desired extent, the nut 19 is tightened against the carriage 13 to hold the hinge pin against rotation, and hence keep the panels at the desired height.

Although the combination carrier and hinge assembly of FIGS. 1–3 is advantageous in that it facilitates adjustment of the panels, the locking nut may work loose over time. The locking nut may also be difficult to access.

Figure 4:
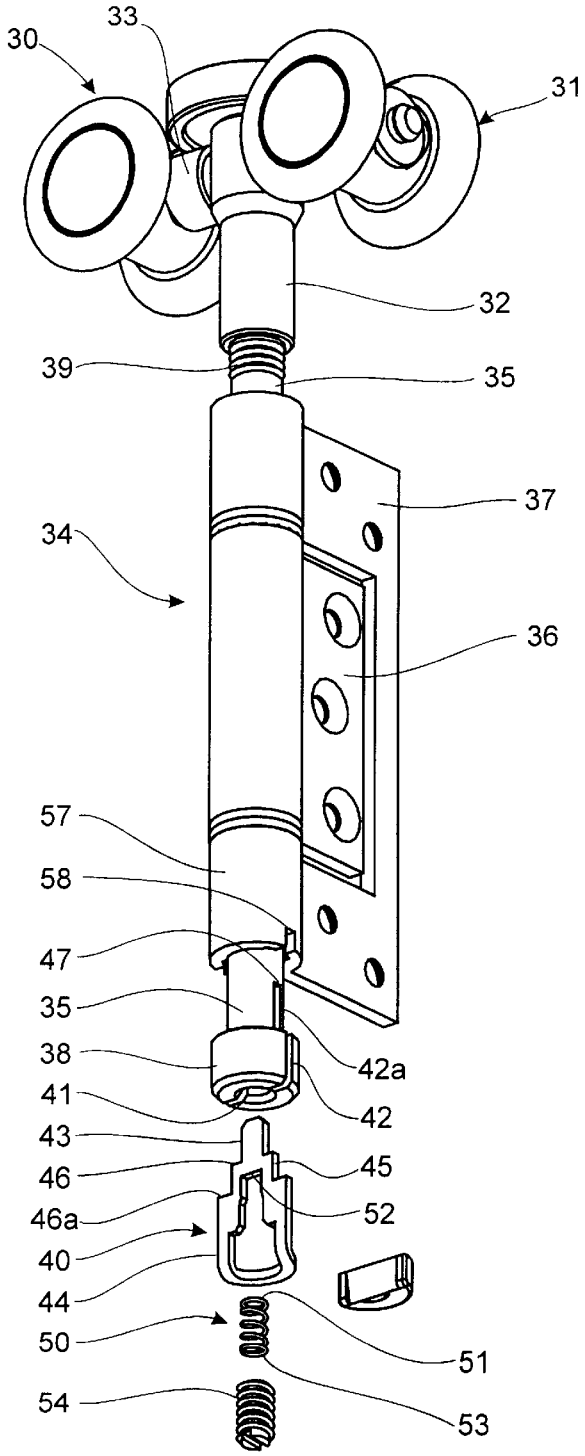
FIG. 4 is a perspective view of a carrier hinge assembly according to a first embodiment of the invention, with its locking mechanism shown in exploded view.

FIG. 4 illustrates a carrier hinge assembly according to one embodiment of the invention. The carrier hinge assembly has a carriage 30 provided with two sets of wheels 31. Carriage 30 also has a depending boss 32 having a threaded bore, which in use, is orientated vertically. Boss 32 also has an upper horizontal bore (not shown) through which a shaft 33 passes. The two pairs of wheels of the carriage are mounted at opposite ends of the shaft.

A hinge 34 is suspended from carriage 30. Hinge 34 comprises a hinge pin 35 and a pair of hinge leaves, namely an inner leaf 36 and an outer leaf 37, which can slide along and rotate about the hinge pin 35. In use, the hinge leaves 34, 35 are fixed to the opposing edge faces of adjacent panels of a folding door, window, screen or similar closure. The hinge leaves 36, 37 are prevented from sliding off hinge pin 35 by a lower stop 38. Stop 38 is formed by an enlarged head at the bottom of the hinge pin 35.

The upper end of hinge pin 35 has a threaded portion 39 that threadingly engages in the bore of boss 32. Rotation of hinge pin 35 varies the axial spacing between the hinge leaves and carriage 30, and thus adjusts the height of the door panels mounted on the hinge leaves, as described above with reference to FIGS. 1–3.

A blind axial bore 41 is provided in the stop 38 and extends into the adjacent lower part of the hinge pin 35. Additionally, an axial slot is formed in the stop 38 and the lower part of hinge pin 35, to thereby form diametrically opposed slots 42 (in the stop 38) and 42*a* (in the lower part of the hinge pin 35). This axial slot is formed by a transverse cut along a diameter of the hinge pin, which extends axially in depth.

The embodiment of FIG. 4 has a locking mechanism which locks the hinge pin 35 against undesired rotation, and therefore prevents loss of adjustment. The locking mechanism comprises a locking member in the form of a lock tongue or key 40 which is used to prevent relative rotation between the hinge pin 35 and the outer hinge leaf 37.

Lock tongue 40 has a narrow front nose portion 43 which is received in the bore 41, an intermediate portion 45 having a width the same as, or less than, the diameter of the pin 35 and which locates in the slots 42*a*, and a rear or outer portion 44 having a width approximately the same as the outer diameter of stop 38, as can be seen in FIG. 4. A shoulder 46 is formed by the stepped transition between the nose portion 43 and the intermediate portion 45. A shoulder portion 46*a* is also formed by the stepped transition between intermediate portion 45 and the rear portion 44.

Upon insertion of the lock tongue 40 into bore 41, the shoulder portion 46 abuts against the inner end 47 of slot 42*a*, thereby limiting the extent of insertion of the lock tongue 40. The outer portion 44 locates in the slots 42, and is substantially flush with the outer cylindrical wall of stop 38. The axial length of portion 44 is longer than the axial length of stop 38, so that the leading radial edges of portion 44 which form shoulder 46*a* locate forward of the stop 38 and radially outside the lower portion of pin 35. The shoulder portions 46*a* form keys which lock in respective slots in the hinge leaf 37 as described below.

Lock tongue 40 is biased forward into a locking or inserted position in the hinge pin 35 by a helical spring 50 located in bore 41. The lock tongue 40 has a stepped internal cut-out in which the spring 50 locates. The inner end 51 of spring 50 abuts against a forward edge 52 of the cut-out. The spring is retained in the bore by any suitable means. For example, a grub screw 54 or other type of insert can be screwed or inserted in the bore to retain the spring 50 therein. During assembly of the locking mechanism, the lock tongue 40 is pushed into the bore 41, and the spring 50 is inserted into the bore within the cut-out of the lock tongue. Thereafter, a grub screw 54 or other insert is threaded or otherwise inserted into the bore to compress spring 50. The screw or insert is held in the bore 41 by the walls of the bore. The grub screw or insert does not prevent axial movement of the lock tongue 40 since the cut-out in the lock tongue is wider than the diameter of the screw or insert.

Other retention arrangements for the spring 50 may be used. For example, in an alternative embodiment, the outer end 53 of the spring may be held in an annular groove (note shown) in the internal wall of bore 41, thereby avoiding the need for a separate insert.

Figure 5:
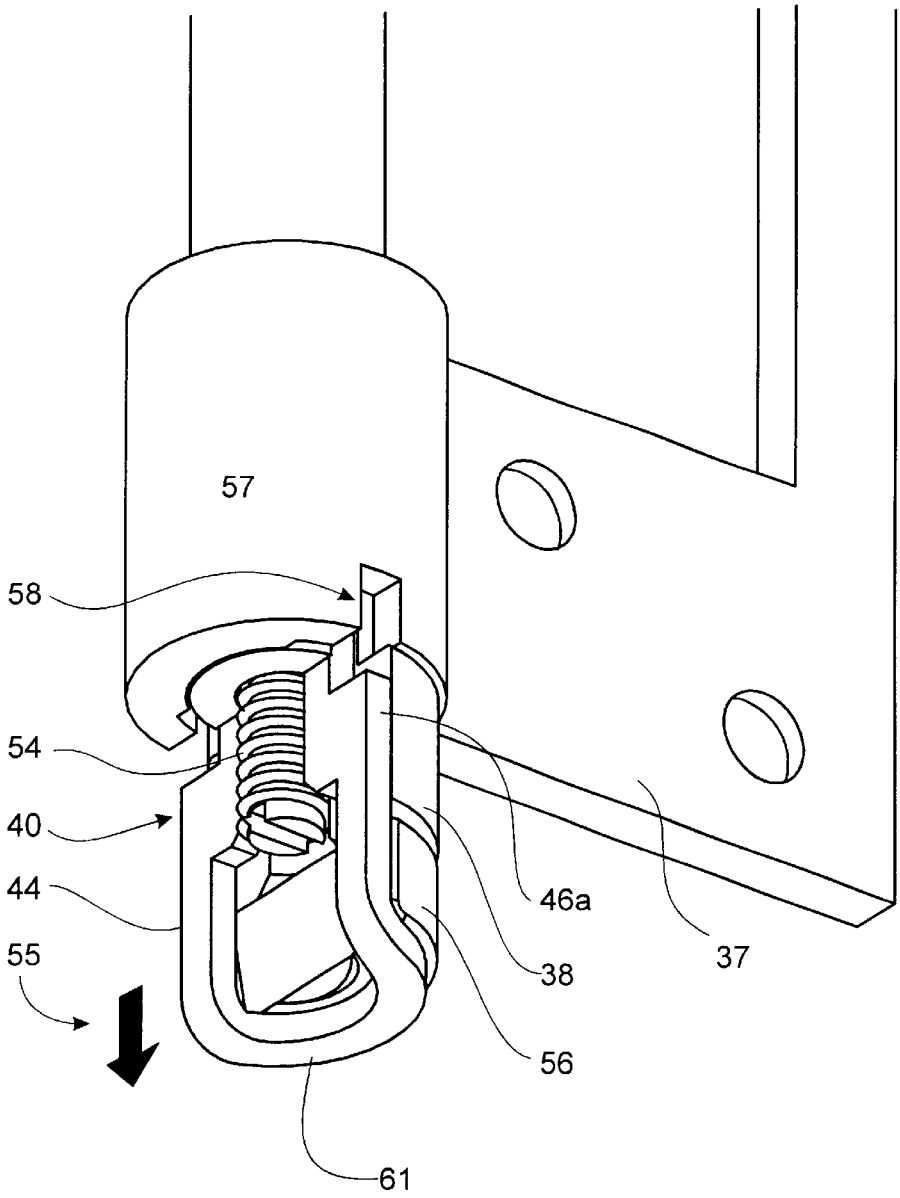
FIG. 5 is a perspective view of the locking mechanism in its retracted or unlocked position.

FIG. 5 illustrates the lock tongue 40 in an unlocked or retracted position, with stop 38 shown in partially cutaway section to show the internal components more clearly. Lock tongue 40 has been pulled outwardly in the direction of arrow 55 against the bias of the spring 50, and is held in its retracted position by a removable clip 56.

Outer hinge leaf 37 has a knuckle portion 57 surrounding the hinge pin. The lower portion of knuckle 57 has a pair of diametrically opposite, axial slots 58 on its lower edge, which are of similar width as slots 42, 42*a*. The slots 58 can be formed by cutting the lower end of the knuckle transversely along a diameter thereof, the depth of the cut defining the axial extent of the slots 58. Slots 58 can align with slots 42 when the hinge pin (and stop 38) are rotated to either of two diametrically opposite angular orientations. (Note that although only one set of slots 58 is shown in the illustrated embodiment, additional slots can be provided if desired).

When the clip 56 is removed, the lock tongue 44 is urged forward under the spring bias and, if the slots 42, 58 are aligned, the shoulder portions 46*a* locate in the slots 58. This effectively keys the stop 38 and hinge pin 35 rotationally to the knuckle 57. At this locked position, the hinge pin 35 is positively locked against rotation relative to the hinge leaf 37, as illustrated in FIG. 6.

Figure 6:
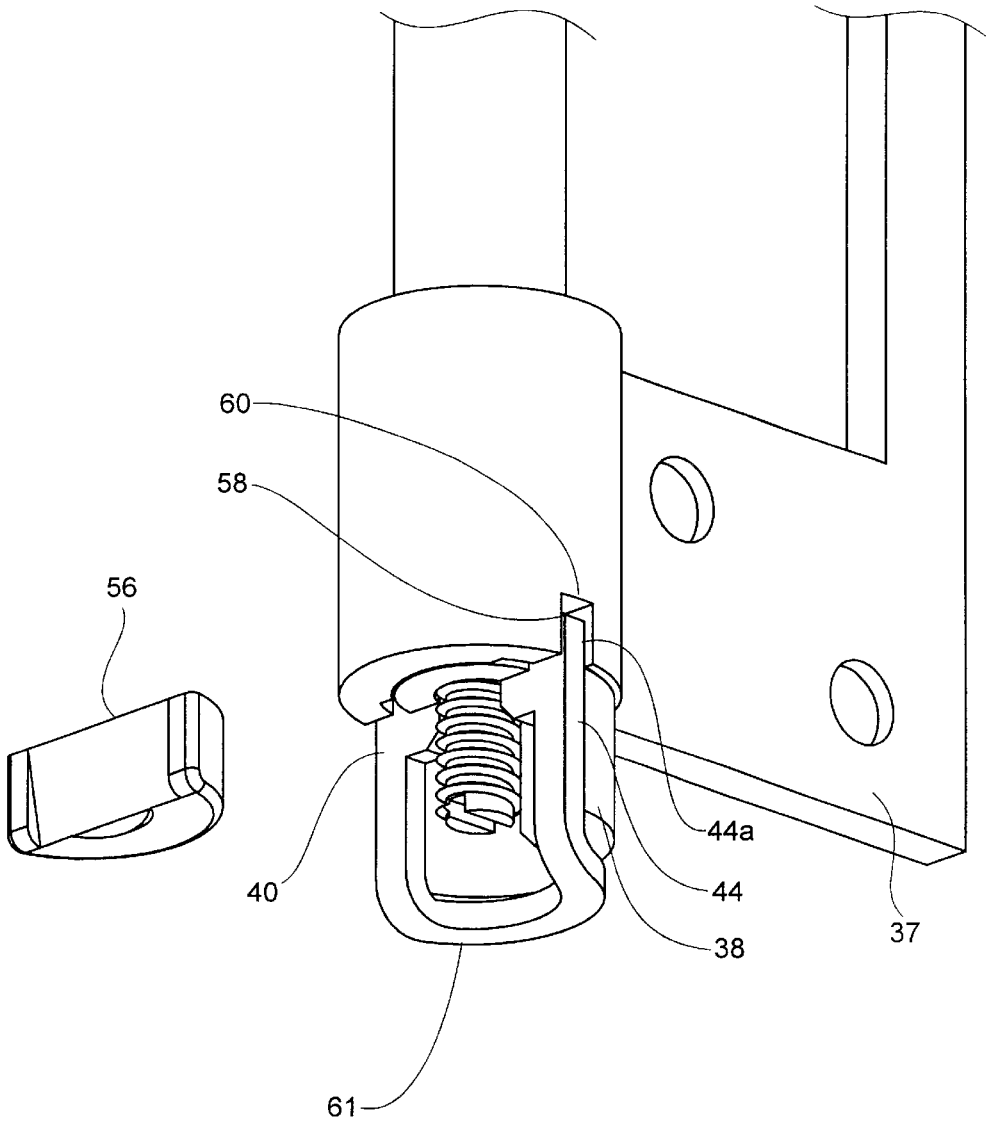
FIG. 6 is a perspective view of the locking mechanism in its inserted or locked position.

In the locked or inserted position illustrated in FIG. 6, shoulder portion 46 abuts against the blind end 47 of slot 42*a* thereby preventing further forward movement of lock tongue 40. The rear or outer end 61 of lock tongue 40 is L-shaped, and overlies part of the outer end of stop 38. However, outer end 61 does not directly abut against the outer end of stop 38 but is slightly spaced therefrom (typically 1–3 mm) to allow a screwdriver blade to be wedged between the locked tongue end 61 and the outer end of stop 38 to facilitate retraction of the lock tongue against the bias of the spring 50.

Clip 56, which holds the lock tongue in its retracted (unlocked) position, is used principally as a "shipping clip". It is removed by the installer to enable the lock tongue to engage the knuckle 57 and lock the hinge pin against rotation relative to the hinge knuckle. Clip 56 is preferably brightly coloured, to make it clearly visible to the installer.

In use, the carrier hinge assembly is packaged with the shipping clip 56 in place, and therefore with the lock tongue 40 in its retracted (unlocked) position. This permits the hinge pin to rotate freely relative to the hinge leaves 36, 37. The carrier hinge assembly is attached to a pair of doors, with each hinge leaf being secured to the edge face of a respective door panel. The carriage is then placed on the track to suspend the door panels therefrom. The doors are supported on the hinge leaves which, in turn, are supported on the stop 38 of the hinge pin 35. Hinge pin 35 is threaded into the carriage 30 and is suspended therefrom.

The height of the panels is adjusted by rotating the hinge pin to screw it in or out of the boss nut 32, as required. The hinge pin can be rotated either by manually rotating stop 38, or by using a screw driver inserted into the bore 41 to engage the screw driver slot on the grub screw 54. Once the vertical adjustment has been finalised, the shipping clip 56 can be removed, to permit the spring 50 to push the lock tongue forward into a locking position. However, if the slots 42 on stop 38 are not aligned with slots 58 on knuckle 57, the stop 38 is rotated until the slots are aligned, at which stage the lock tongue will shoot forward under spring bias into its locked position.

Although some rotation of the hinge pin may be required to align the slots, this should not be more than +/−90°. In view of the small screw pitch of the threaded portion 39, this will not substantially effect the vertical position of the door panels.

At the locked position, the shoulders 46*a* key into slots 58 and thereby rotationally lock the hinge pin to hinge leaf 37, as can be seen in FIG. 6.

By positively locking the hinge pin rotationally to the hinge leaf, and hence to the associated door panel, excessive rotation of the hinge pin is prevented since the door panel has limited rotational movement. (As the doors are folded between their open and close positions, hinge leaf 37 will rotate typically up to 90°, and therefore the hinge pin will also rotate by a quarter turn at the most. If the adjustment is set when the door is at 45°, the hinge pin will rotate clockwise and anticlockwise by one-eighth turn about a mid position. The resultant small variation in the height of the door is typically less than 0.5 mm and therefore not substantial.

Due to the nature of the positive locking between the hinge pin and the hinge leaf 37, there is no loosening of the locking arrangement over time as can occur with prior art lock nuts.

If subsequent height adjustment is required, the lock tongue can be easily retracted against the bias of the spring by wedging a screw driver between the angled end 61 of the lock tongue and the bottom face of stop 38. The hinge pin can then again be rotated for further adjustment, after which the lock tongue can be released forward into aligned slots 58 to rotationally lock the hinge pin positively relative to the hinge leaf 37.

Figure 7:
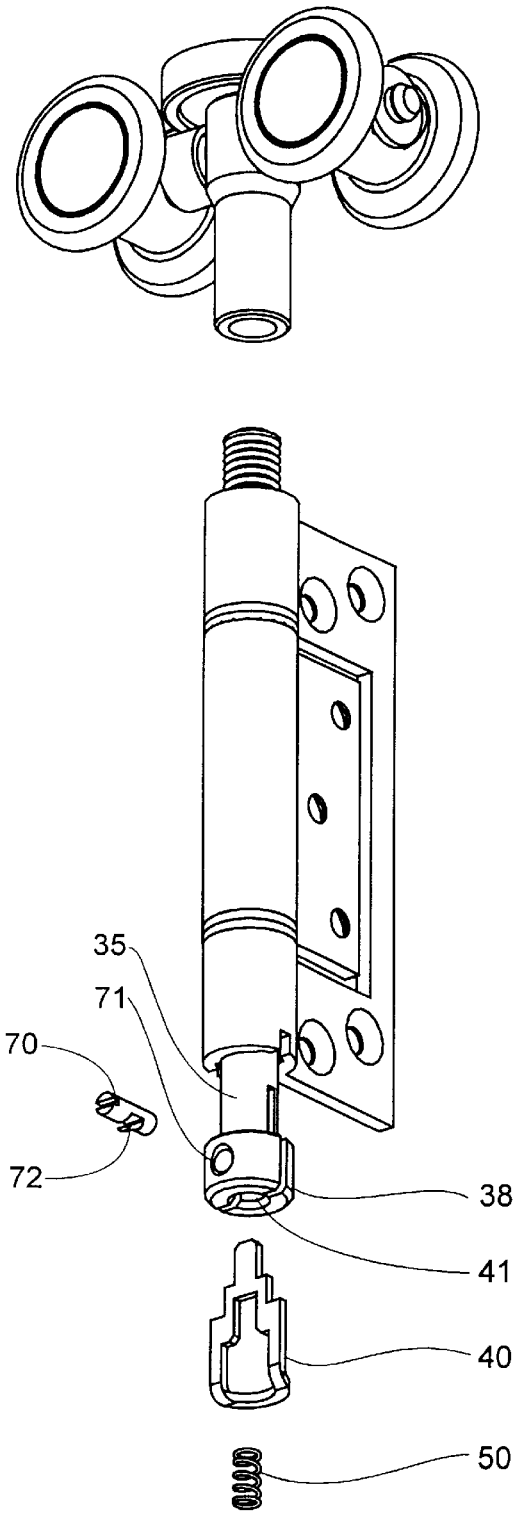
FIG. 7 is an exploded perspective view of a carrier hinge assembly according to a second embodiment of the invention.

It should be appreciated that various changes and modifications may be made to the above described embodiments without departing from the scope of the invention as defined in the appended claims For example, in a further embodiment, illustrated in FIG. 7, a transverse pin 70 is used to retain the spring 50 in the bore 41 of lock pin 35. The pin 70 is inserted in a cross-drilled hole 71 in the stop 38. The pin may be threaded in the hole, or may be provided with a detent or barb 72 to retain the pin 70 in the stop 38.

Figure 8:
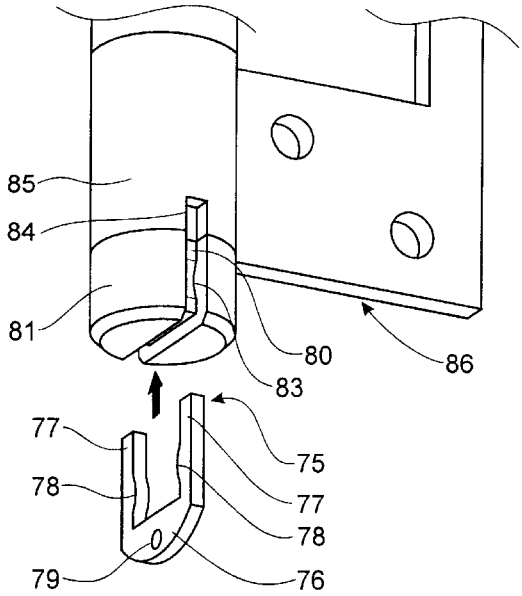
FIG. 8 is an exploded perspective view of the bottom portion of a carrier hinge assembly according to a third embodiment of the invention.
Figure 9:
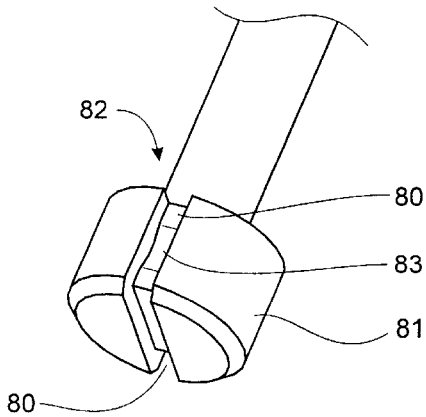
FIG. 9 is an underside perspective view of the head of the hinge pin of the embodiment of FIG. 8.
Figure 10:
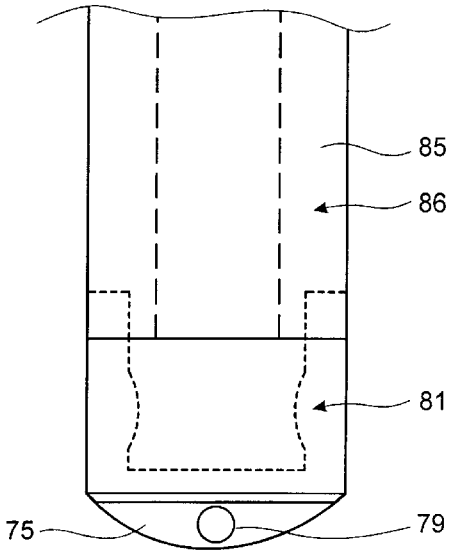
FIG. 10 is a side elevational view of the bottom portion of the carrier hinge assembly of FIG. 8.

An alternative embodiment is illustrated in FIGS. 8 to 10. Apart from the locking mechanism, the carrier hinge assembly of FIGS. 8 to 10 is similar in construction to the embodiment of FIG. 4, and only the bottom part of the assembly is depicted to illustrate the locking mechanism.

The locking mechanism comprises a locking member in the form of a U-shaped key or clip 75. The lock key 75 has a web 76 extending between two legs 77, each leg 77 having a cam-like node or detent 78 on its inside. The web 76 is preferably provided with a hole 79 or other formation to facilitate grasping, as described below.

A slot 80 is provided in the head 81 of the hinge pin 82 of the carrier hinge assembly. The slot 80 may suitably be milled in the head 81. The slot 80 extends axially in opposite sides of the head 81, as well as radially along a transverse diameter in the bottom of the head 81, as illustrated in FIG. 9. A shallow recess 83, corresponding in shape and size to the detents 78, is provided in each axial portion of the slot 80.

A pair of diametrically opposed axial slots 84 are provided in the knuckle 85 of the hinge leaf 86, similar to the slots 58 of the embodiment of FIG. 4.

In use, after the hinge pin 85 has been rotated to adjust the height of the panels (not shown) supported by the carrier hinge assembly, the slot 80 is axially aligned with slots 84. The U-shaped clip 75 is then inserted into slot 80, and into engagement with the slots 84. The initial push will need to overcome the resistance of the cam-like detents 78 engaging opposite sides of the head 81, but when the detents 78 engage in the respective recesses 83, the key 75 will be retained on the head 81 in a snap-lock manner with the distal portions of the legs 78 engaged in the axial slots 84, as depicted in FIG. 10.

The resulting arrangement is a compact, aesthetically pleasing assembly in which the hinge pin is keyed to a hinge leaf.

The web portion protrudes below the slot 80 to facilitate removal of the key 75 to permit subsequent adjustment. For example, a wire may be inserted through hole 79 to enable the key 75 to be pulled out of engagement with the slots 84 in the hinge 86. After such further adjustment, the U-shaped key 75 may be snap-locked back into engagement with the slots 84.

What is claimed is:

1. A carrier hinge assembly for suspending adjacent panels from a track, the assembly including:

a carriage adapted to travel along the track;

hinge comprising a hinge pin depending from the carriage, the hinge pin being rotatable about its longitudinal axis relative to the carriage, and at least one hinge leaf pivotable about the hinge pin, the hinge leaf being adapted to be fixed to an edge face of a respective panel, in use; and a locking mechanism for keying the hinge pin to the hinge leaf to prevent relative rotation therebetween.

2. An assembly as claimed in claim 1, wherein the hinge pin is adjustably threaded into the carriage, the distance between the hinge leaf and the carriage being variable by rotation of the hinge pin about its axis.

3. An assembly as claimed in claim 2, wherein the carriage has a depending boss with a threaded bore therein, the hinge pin having a threaded upper end which, in use, is threaded into the bore.

4. An assembly as claimed in claim 2, wherein the locking mechanism comprises a lock member adapted to locate simultaneously in the hinge pin and the hinge leaf so that the hinge pin is keyed to the hinge leaf to thereby prevent relative rotation between the hinge pin and the hinge leaf.

5. An assembly as claimed in claim 4 wherein the hinge pin has a first axial slot in its lower end, and the hinge leaf has a second axial slot in its lower end, said first and second slots being axially alignable by relative rotation of the hinge leaf and the hinge pin, wherein when the slots are axially aligned, the lock member may locate in the slots to key the hinge pin to the hinge leaf.

6. An assembly as claimed in claim 5, wherein the hinge leaf has a knuckle surrounding the hinge pin, the second slot being located in a lowermost edge portion of the knuckle.

7. An assembly as claimed in claim 5, wherein the hinge pin has an enlarged head at the lower end thereof forming an axial stop for the hinge leaf, the first slot extending axially through the enlarged head and into the hinge pin.

8. An assembly as claimed in claim 7, wherein the lock member is a planar key member located in the first slot, the assembly further comprising a biasing device for biasing the key member into engagement with the second slot, the key member being retractable against the bias of the biasing device to withdraw from the second slot and thereby permit relative rotation between the hinge pin and the hinge leaf.

9. An assembly as claimed in claim 8, wherein the hinge pin has an axial bore in its lower end extending through the head and into the hinge pin.

10. An assembly as claimed in claim 9, wherein the biasing device is a coil spring housed in the axial bore in the head, and located in a cut-out in the planar key member.

11. An assembly as claimed in claim 8, wherein the key member has an angled portion at a lower end thereof overlying the lower end of the hinge pin, the assembly further comprising a removable spacer for holding the key member in a retracted position against the bias of the biasing device.

12. An assembly as claimed in claim 7 wherein the lock member is a U-shaped key member having a pair of legs adapted to slide axially in respective first slots in the head and engage in respective second slots in the hinge leaf.

13. As assembly as claimed in claim 12 wherein the lock member has a detent on its legs which engages with the head to retain the lock member in engagement in the second slots.

14. A carrier hinge assembly for suspending adjacent panels from a track in a hinged relationship, the assembly comprising:

a carriage adapted to travel along the track;

a hinge comprising a hinge pin having its upper end threaded into the carriage, and a pair of hinge leaves pivotable about the hinge pin, each hinge leaf being adapted to be fixed in use to an edge of a respective panel; and a locking mechanism for locking the hinge pin rotationally relative to one of the hinge leaves.

15. An assembly as claimed in claim 14, wherein the locking mechanism comprises a lock member locatable in the hinge pin, the lock member being adapted to move axially between a locked position whereat it engages the hinge leaf and locks the hinge leaf rotationally to the hinge pin, and an unlocked position whereat the lock member is disengaged from the hinge leaf and permits the hinge leaf to pivot about the hinge pin.

16. An assembly as claimed in claim 15, wherein the hinge leaf has a knuckle portion with a first axial slot therein, and the hinge pin has a head at the lower end thereof with a second axial slot extending through the head, the lock member being located in the second slot, and engageable with the first slot when the slots are axially aligned.

17. An assembly as claimed in claim 16, further comprising a spring located in the hinge pin for biasing the lock member into engagement with the first slot.

18. An assembly as claimed in claim 15, wherein the lock member is a U-shaped key having a pair of legs adapted to slide axially in respective first slots in a head portion of the hinge pin and engage in respective second slots in said one of the hinge leaves.

19. An assembly as claimed in claim 18, wherein the lock member has a detent on each of its legs which engages with a respective recess in the head portion to retain the lock member in engagement in the second slots.

* * * * *